US008590600B2

(12) United States Patent
Kim

(10) Patent No.: US 8,590,600 B2
(45) Date of Patent: Nov. 26, 2013

(54) CLEANING BRUSH DEVICE FOR CONDENSER

(76) Inventor: Brian S. Kim, Rancho Palos Verdes, CA (US)

( * ) Notice: Subject to any disclaimer, the term of this patent is extended or adjusted under 35 U.S.C. 154(b) by 710 days.

(21) Appl. No.: 12/792,623

(22) Filed: Jun. 2, 2010

(65) Prior Publication Data

US 2011/0296641 A1 Dec. 8, 2011

(51) Int. Cl.
*F28G 1/02* (2006.01)
*F28G 1/12* (2006.01)

(52) U.S. Cl.
USPC ..... 165/95; 15/38; 62/303

(58) Field of Classification Search
USPC ..... 165/94, 95; 15/88.4, 381; 134/82, 90, 134/105; 62/303
See application file for complete search history.

(56) References Cited

U.S. PATENT DOCUMENTS

| | | | | |
|---|---|---|---|---|
| 4,660,627 | A * | 4/1987 | Deck | 165/86 |
| 5,211,028 | A * | 5/1993 | Remo | 62/303 |
| 2007/0062211 | A1 * | 3/2007 | Anderson et al. | 62/303 |

FOREIGN PATENT DOCUMENTS

| | | | |
|---|---|---|---|
| JP | 10188110 | A * | 7/1998 |
| JP | 10289368 | A * | 10/1998 |
| JP | 11103936 | A * | 4/1999 |
| JP | 2000235666 | A * | 8/2000 |
| JP | 2000249493 | A * | 9/2000 |
| JP | 2001280893 | A * | 10/2001 |

* cited by examiner

*Primary Examiner* — Tho V Duong
(74) *Attorney, Agent, or Firm* — John K. Park; Park Law Firm

(57) ABSTRACT

A cleaning brush device for a condenser of refrigerator comprising a condenser and a cleaning brush is provided. The condenser comprises a cooling fin grid of rows of horizontal fins and columns of vertical fins. The cleaning brush sweeps horizontally and vertically over the cooling fin grid in a predetermined period of time and brushes off the dust bunny collected in the cooling fin grid. The predetermined period of time is controlled according to amount of the dust bunny on the cooling fin grid. The cleaning brush may sweep the grid horizontally and vertically in a systematical way.

16 Claims, 6 Drawing Sheets

CLEANING BRUSH DEVICE FOR CONDENSER

BACKGROUND OF THE INVENTION

The present invention relates to a cleaning brush device for condenser. More particularly, this invention relates to a cleaning brush device for condenser, which facilitates the efficiency of the condenser.

A cooling fin grid of condenser tends to collect dust bunny or greasy debris over its grid structure. Such dust bunny blocks part of the gaps of the grid and hinders heat exchange, resulting reducing the efficiency of condensing of the condenser.

Therefore, getting rid of the dust bunny from the grid structure of the condenser is desired.

Many solutions to these problems have been suggested, but with only a partial success.

Accordingly, a need for a cleaning brush device for condenser has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a cleaning brush device for condenser of a refrigerator.

Another object of the invention is to provide a cleaning brush device for condenser of a refrigerator, which can facilitate the efficiency of the condenser.

Still another object of the invention is to provide a cleaning brush device for condenser of a refrigerator, which facilitates air flow through the condenser.

An aspect of the invention provides a cleaning brush device for condenser of a refrigerator.

A cleaning brush device for a condenser of refrigerator comprises a condenser and a cleaning brush.

The condenser comprises a cooling fin grid of a plurality of rows of horizontal fins and a plurality of columns of vertical fins.

The cleaning brush is configured to brush dust bunny off a surface of the cooling fin grid.

The cleaning brush sweeps horizontally and vertically over the cooling fin grid in a predetermined period of time and brushes off the dust bunny collected in the cooling fin grid.

The predetermined period of time is controlled according to amount of the dust bunny on the cooling fin grid.

The cleaning brush may sweep a first row horizontally in a first direction from a first side of the cooling fin grid to a second side of the cooling fin grid, move down and sweeps vertically to a second row at the second side of the first row, and then sweep the second row horizontally from the second side of the cooling fin grid to the first side of the cooling fin grid.

The cleaning brush may sweep the rows and columns of the cooling fin grid from a top row to a bottom row for a first sweeping cycle.

The cleaning brush may retrace the rows and columns of the cooling fin grid back from a bottom row to a top row for a second sweeping cycle, and the first and second sweeping cycles may be consecutive such that motion line of the cleaning brush is minimized.

A term between the first and second sweeping cycles may be equal to the predetermined period of time.

The cleaning brush may vibrate during sweeping.

The predetermined period of time may be adjusted by a performance of the condenser.

The condenser may comprise a performance detector, and the predetermined period of time may be adjusted according to an output of the performance detector.

The performance detector may comprise a first pressure sensor disposed at an input side of the condenser and a second pressure sensor disposed at out output side of the condenser.

The cleaning brush may be operated when the ratio of a reading of the second pressure sensor to a reading of the first pressure sensor is above a predetermined value.

The performance detector may further comprise a controller for processing outputs from the first and second pressure sensors and controlling operation of the cleaning brush.

The cleaning brush device may further comprise two vertical guide rails, a horizontal guide rail, and a slidable mount.

The two vertical guide rails may be installed along both outermost columns of the cooling fin grid.

The horizontal guide rail may have two end portions engaging the two vertical guide rails so as to slide vertically.

The slidable mount may be disposed on the horizontal guide rail for mounting the cleaning brush.

The vertical movement of the horizontal guide rail and the horizontal movement of the slidable mount may be controlled to sweep the cooling fin grid to brush the dust bunny off the cooling fin grid.

The slidable mount may comprise an electrical motor, and the horizontal guide rail may comprise an electrical motor.

The cleaning brush may comprise a rotary brush. The rotary brush may be translated along the horizontal guide rail and rotated by an electrical motor.

Alternatively, the cleaning brush may comprise a vibrating brush, and the vibrating brush may be translated along the horizontal guide rail and vibrated by an electrical motor.

The advantages of the present invention are: (1) the cleaning brush device for condenser facilitates the efficiency of the condenser; and (2) the cleaning brush device for condenser can facilitate air flow through the condenser.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
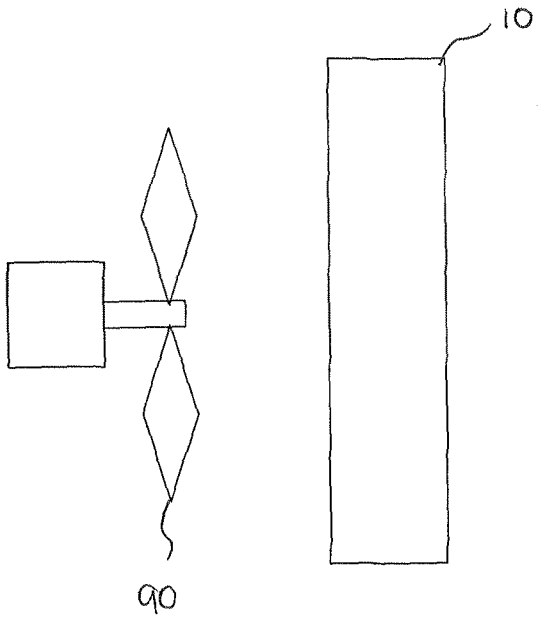
FIG. 1 is a schematic diagram view showing a condenser and a fan of a refrigerator.

FIG. 1 shows a condenser 10 and a fan 90 of a refrigerator. FIGS. 2-6 show cleaning brush devices 100 for condenser according to certain embodiments of the invention.

In a regular refrigerator, the fan 90 blows air to the condenser 10 to facilitate the heat exchange in the condenser 10.

A cleaning brush device 100 for a condenser of refrigerator comprises a condenser 10 and a cleaning brush 20.

Figure 2:
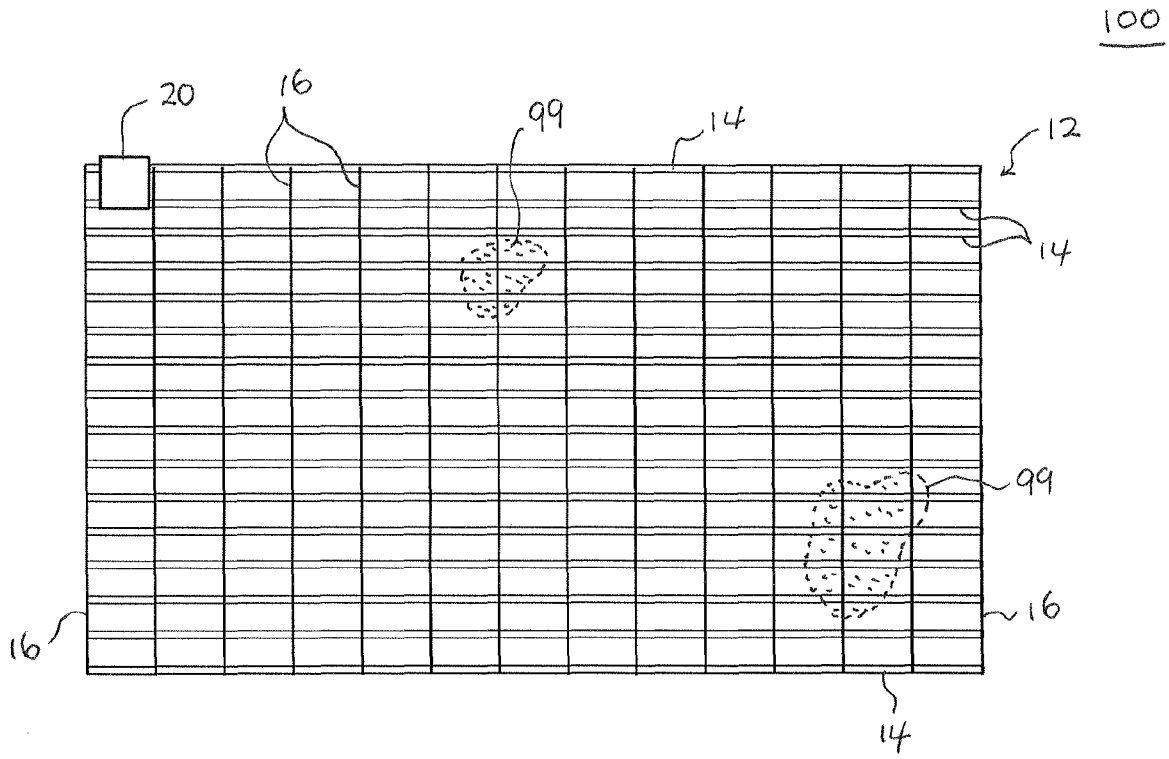
FIG. 2 is a perspective plan view of a cleaning brush device according to an embodiment of the present invention.

The condenser 10 comprises a cooling fin grid 12 of a plurality of rows of horizontal fins 14 and a plurality of columns of vertical fins 16 as shown in FIG. 2.

The cleaning brush 20 is configured to brush dust bunny 99 off a surface of the cooling fin grid 12.

The cleaning brush 20 sweeps horizontally and vertically over the cooling fin grid 12 in a predetermined period of time and brushes off the dust bunny 99 collected in the cooling fin grid 12.

In FIG. 2, the cleaning brush 20 may move over the surface of the cooling fin grid 12 following any arbitrary trajectory. However, in order to optimize the movement, the cleaning brush 20 may move horizontally or vertically, preferably in compound trajectory including horizontal and vertical unit movements, which depends on the size of a mesh of the grid.

The predetermined period of time is controlled according to amount of the dust bunny 99 collected on the cooling fin grid 12. If the refrigerator is operated in a dirty environment, then the predetermined period of time may be reduced to be short, operating as frequently as necessary. In a clean environment, it might be lengthened accordingly.

The cleaning brush 20 may sweep a first row horizontally in a first (higher) direction from a first (left) side of the cooling fin grid 12 to a second (right) side of the cooling fin grid 12, moves down and sweeps vertically to a second (next lower) row at the second (right) side of the first row, and then sweep the second row horizontally from the second (right) side of the cooling fin grid 12 to the first (left) side of the cooling fin grid 12, for example, in FIG. 2.

Figure 3:
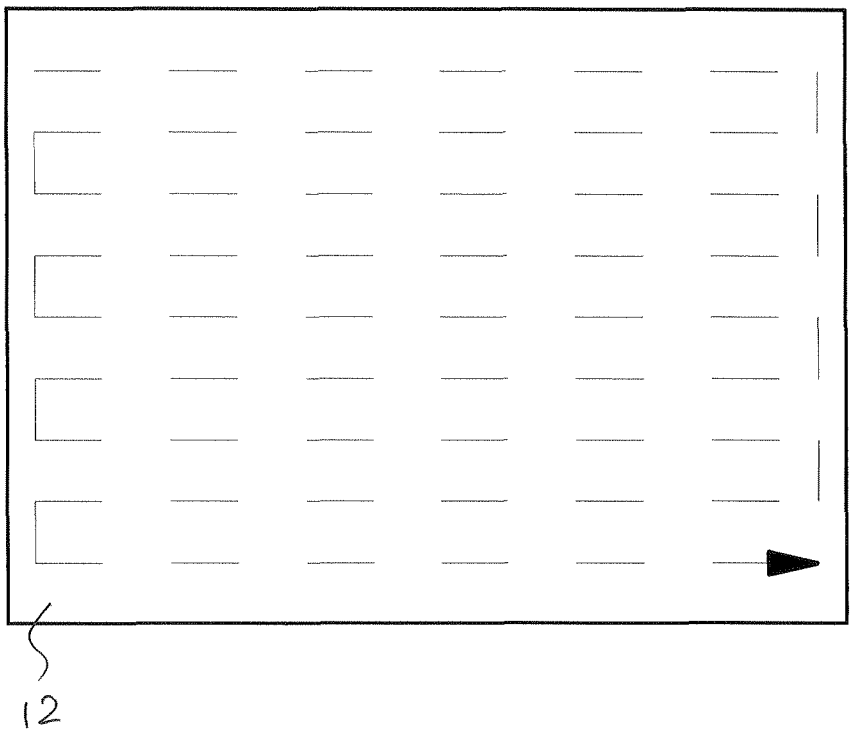
FIG. 3 is a schematic diagram showing a sweeping track of a cleaning brush device according to an embodiment of the present invention.

The cleaning brush 20 may sweep the rows and columns of the cooling fin grid 12 from a top row to a bottom row for a first sweeping cycle as shown in FIG. 3.

Figure 4:
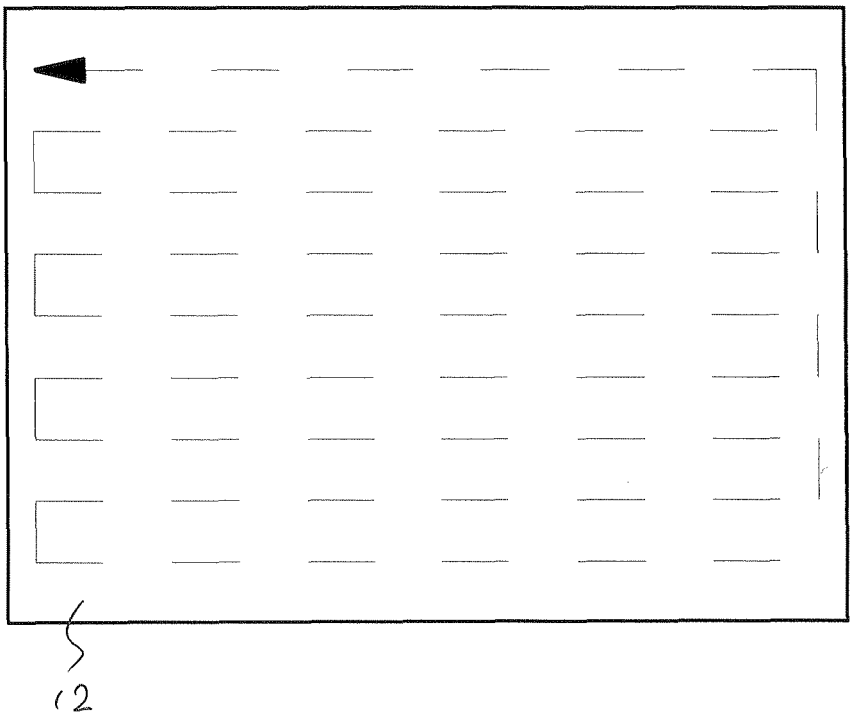
FIG. 4 is a schematic diagram showing another sweeping track of a cleaning brush device according to another embodiment of the present invention.

The cleaning brush 20 may retrace the rows and columns of the cooling fin grid 12 back from a bottom row to a top row for a second sweeping cycle as shown in FIG. 4, and the first and second sweeping cycles may be consecutive such that motion line of the cleaning brush 20 is minimized.

A term between the first and second sweeping cycles may be equal to the predetermined period of time.

The cleaning brush 20 may vibrate during sweeping in order to facilitate dusting off of the dust bunny 99.

The predetermined period of time may be adjusted by a performance of the condenser 10. The performance of the condenser 10 may depend on the amount of the dust bunny 99 accumulated on the cooling fin grid 12.

The condenser 10 may comprise a performance detector 18, and the predetermined period of time may be adjusted according to an output of the performance detector 18.

Figure 5:
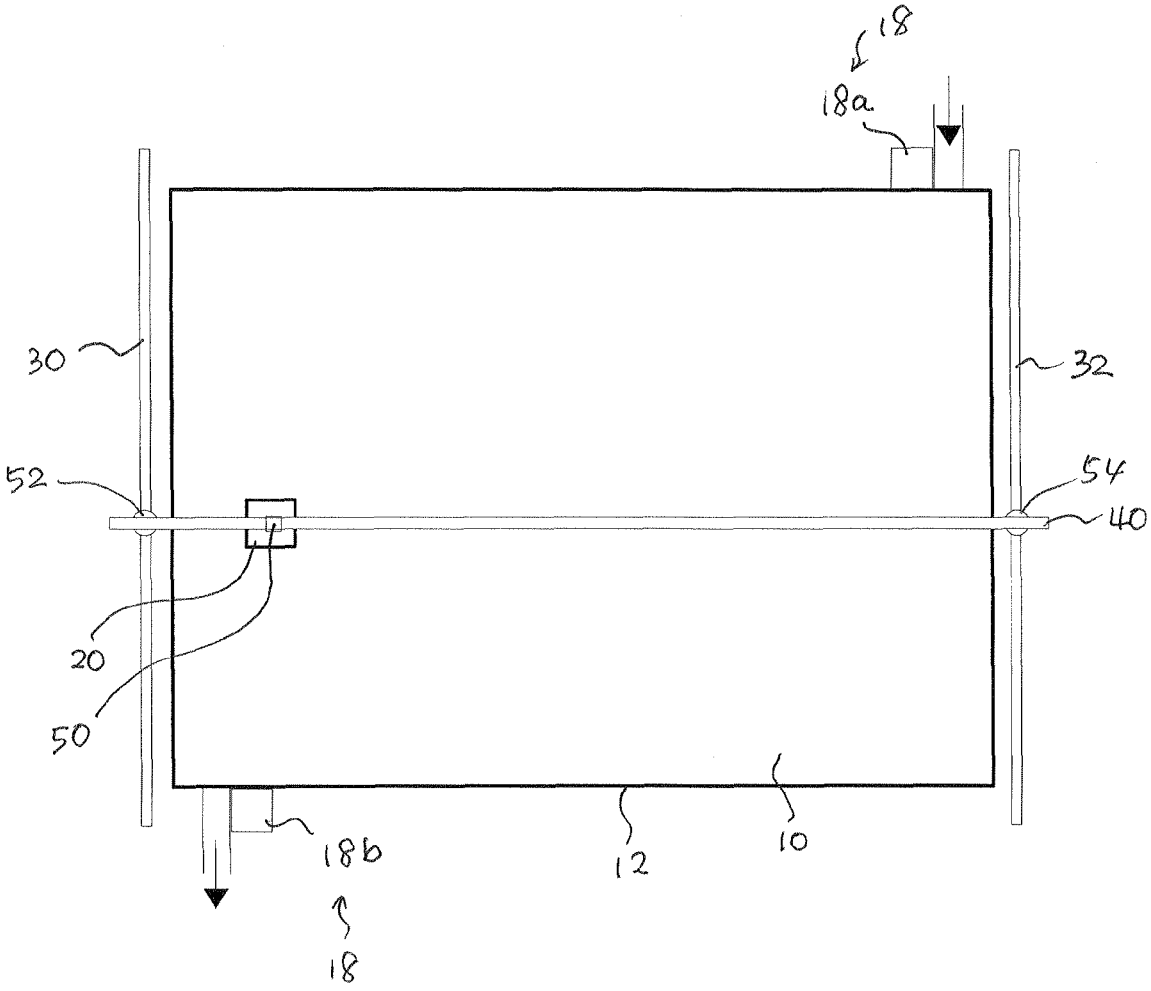
FIG. 5 is a perspective view of a cleaning brush device with guide rails according to an embodiment of the present invention.

The performance detector 18 may comprise a first pressure sensor 18*a* disposed at an input side of the condenser 10 and a second pressure sensor 18*b* disposed at out output side of the condenser 10 as shown in FIG. 5.

The cleaning brush 20 may be operated when the ratio of a reading of the second pressure sensor 18*b* to a reading of the first pressure sensor 18*a* is above a predetermined value. When the condenser 10 is in a normal operation, the ratio can be measured and then used as a reference value to estimate the efficiency of the condenser 10 afterward. If the condenser 10 is clogged by the dust bunny 99, the ratio may decrease below the reference value.

Figure 6:
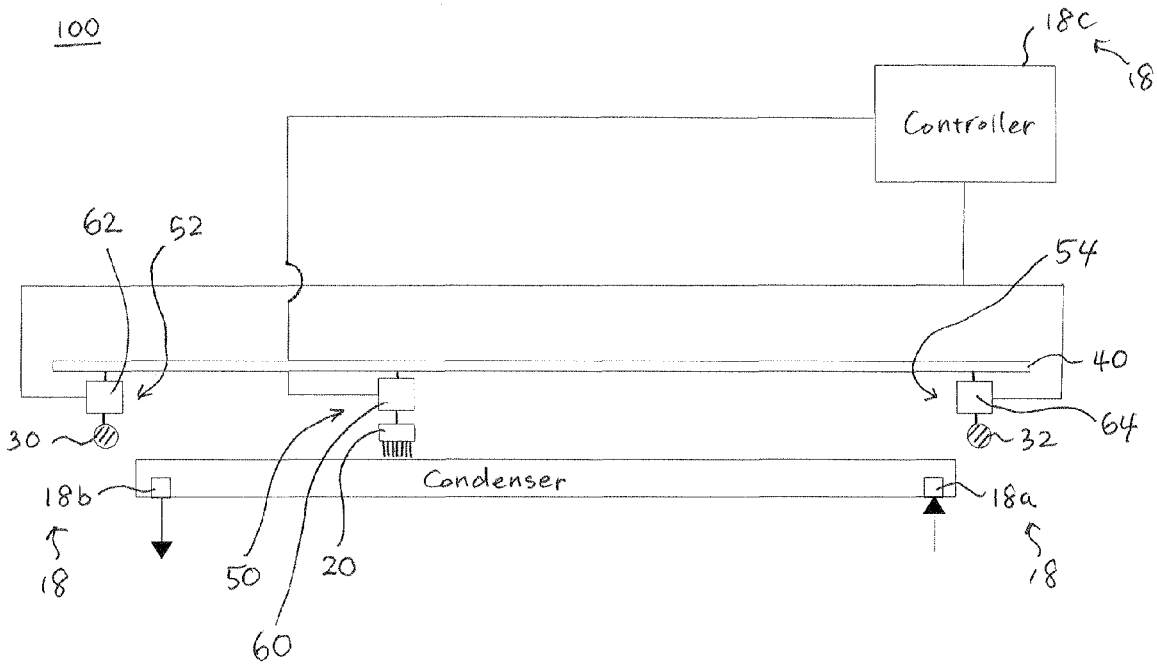
FIG. 6 is a block diagram of a cleaning brush device for condenser according to an embodiment of the present invention.

The performance detector 18 may further comprise a controller 18*c* for processing outputs from the first and second pressure sensors 18*a*, 18*b* and controlling operation of the cleaning brush 20 as shown in FIG. 6. The controller 18*c* may monitor the outputs from first and second pressure sensors 18*a*, 18*b* and start or stop the operation of the cleaning brush 20. The controller 18*c* may further comprise an information processor such as a computer for processing associated data and necessary computing.

In certain embodiments of the invention, the controller 18*c* may monitor other operational parameters to estimate the efficiency of the condenser 10 and decide when to start or stop the operation.

The cleaning brush device 100 may further comprise two vertical guide rails 30, 32, a horizontal guide rail 40, and slidable mounts 50, 52, 54. The slidable mounts 50, 52, 54 are disposed between the cleaning brush 20 and the horizontal guide rail 40 and between the horizontal guide rail 40 and the two vertical guide rails 30, 32 as shown in FIGS. 5 and 6.

The two vertical guide rails 30, 32 may be installed along both outermost columns of the cooling fin grid 12.

The horizontal guide rail 40 may have two end portions engaging the two vertical guide rails 30, 32 so as to slide vertically.

The slidable mount 50 may be disposed on the horizontal guide rail 40 for mounting the cleaning brush 20.

The vertical movement of the horizontal guide rail 40 and the horizontal movement of the slidable mount 50 may be controlled to sweep the cooling fin grid 12 to brush the dust bunny off the cooling fin grid 12.

The slidable mount 50 may comprise an electrical motor 60 for translating the cleaning brush 20 horizontally, and the horizontal guide rail 40 may comprise an electrical motor 62 for translating the horizontal guide rail 40 over the two vertical guide rails 30, 32 vertically. The horizontal guide rail 40 may further comprise another electrical motor 64 and the two electrical motors 62, 64 may be installed between the horizontal guide rail 40 and the two vertical guide rails 30, 32 as shown in FIGS. 5 and 6.

In certain embodiment of the invention, the horizontal guide rail 40 may be anchored to and driven by a separate device other than the two vertical guide rails.

The cleaning brush 20 may comprise a rotary brush. The rotary brush may be translated along the horizontal guide rail 40 and rotated by a separate electrical motor.

Alternatively, the cleaning brush 20 may comprise a vibrating brush, and the vibrating brush may be translated along the horizontal guide rail 40 and vibrated by an electrical motor, for example, the electrical motor 60.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A cleaning brush device for a condenser having a cooling fin grid of a plurality of rows of horizontal fins and a plurality of columns of vertical fins, of refrigerator comprising:

a cleaning brush configured to brush dust bunny off a surface of the cooling fin grid, a rail structure configured to move the cleaning brush horizontally and vertically over the cooling fin grid in a predetermined period of time and brushes off the dust bunny collected in the cooling fin grid, and wherein the predetermined period of time is controlled according to amount of the dust bunny on the cooling fin grid.

2. The cleaning brush device for condenser of claim 1, wherein the cleaning brush sweeps a first row horizontally in a first direction from a first side of the cooling fin grid to a second side of the cooling fin grid, moves down and sweeps vertically to a second row at the second side of the first row, and sweeps the second row horizontally from the second side of the cooling fin grid to the first side of the cooling fin grid.

3. The cleaning brush device for condenser of claim 2, wherein the cleaning brush sweeps the rows and columns of the cooling fin grid from a top row to a bottom row for a first sweeping cycle.

4. The cleaning brush device for condenser of claim 3, wherein the cleaning brush retraces the rows and columns of the cooling fin grid back from a bottom row to a top row for a second sweeping cycle, wherein the first and second sweeping cycles are consecutive such that motion line of the cleaning brush is minimized.

5. The cleaning brush device for condenser of claim 4, wherein a term between the first and second sweeping cycles are equal to the predetermined period of time.

6. The cleaning brush device for condenser of claim 1, wherein the cleaning brush vibrates during sweeping.

7. The cleaning brush device for condenser of claim 1, wherein the predetermined period of time is adjusted by a performance of the condenser.

8. The cleaning brush device for condenser of claim 7, wherein the condenser comprises a performance detector, and wherein the predetermined period of time is adjusted according to an output of the performance detector.

9. The cleaning brush device for condenser of claim 8, wherein the performance detector comprises a first pressure sensor disposed at an input side of the condenser and a second pressure sensor disposed at out output side of the condenser.

10. The cleaning brush device for condenser of claim 9, wherein the cleaning brush is operated when the ratio of a reading of the second pressure sensor to a reading of the first pressure sensor is above a predetermined value.

11. The cleaning brush device for condenser of claim 9, wherein the performance detector further comprises a controller for processing outputs from the first and second pressure sensors and controlling operation of the cleaning brush.

12. The cleaning brush device for condenser of claim 1, wherein the rail structure comprising:

two vertical guide rails installed along both outermost columns of the cooling fin grid;

a horizontal guide rail, two end portions of which engaging the two vertical guide rails so as to slide vertically; and a slidable mount disposed on the horizontal guide rail for mounting the cleaning brush, wherein vertical movement of the horizontal guide rail and horizontal movement of the slidable mount are controlled to sweep the cooling fin grid to brush the dust bunny off the cooling fin grid.

13. The cleaning brush device for condenser of claim 12, wherein the slidable mount comprises an electrical motor, and the horizontal guide rail comprises an electrical motor.

14. The cleaning brush device for condenser of claim 12, wherein the cleaning brush comprises a rotary brush.

15. The cleaning brush device for condenser of claim 14, wherein the rotary brush is translated along the horizontal guide rail and rotated by an electrical motor.

16. The cleaning brush device for condenser of claim 1, wherein the cleaning brush comprises a vibrating brush.

* * * * *